US012270588B2

(12) United States Patent
Schade et al.

(10) Patent No.: US 12,270,588 B2
(45) Date of Patent: Apr. 8, 2025

(54) ICE MAKER WITH CAPACITIVE ICE DETECTION

(71) Applicant: emz-Hanauer GmbH & Co. KGaA, Nabburg (DE)

(72) Inventors: Lukas Schade, Nabburg (DE); Georg Spießl, Altendorf (DE); Sophia Grimm, Nabburg (DE); Manfredi Signorino, Wackersdorf (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 233 days.

(21) Appl. No.: 18/112,867

(22) Filed: Feb. 22, 2023

(65) Prior Publication Data

US 2023/0349612 A1 Nov. 2, 2023

(30) Foreign Application Priority Data

Apr. 27, 2022 (DE) ..... 102022110194.0

(51) Int. Cl.
*F25C 1/10* (2006.01)

(52) U.S. Cl.
CPC ..... *F25C 1/10* (2013.01); *F25C 2305/0221* (2021.08); *F25C 2600/04* (2013.01)

(58) Field of Classification Search
CPC . F25C 1/10; F25C 2305/0221; F25C 2600/04
See application file for complete search history.

(56) References Cited

U.S. PATENT DOCUMENTS

2006/0201170 A1* 9/2006 Cole ..... F25C 1/04 62/340
2012/0247130 A1 10/2012 Ito et al.
2019/0011167 A1* 1/2019 Larson ..... F25C 5/08
2020/0064043 A1 2/2020 Larson et al.
2021/0325099 A1* 10/2021 Cui ..... F16H 21/40

FOREIGN PATENT DOCUMENTS

DE 102016002124 A1 6/2017

* cited by examiner

*Primary Examiner* — Nael N Babaa
(74) *Attorney, Agent, or Firm* — Tarolli, Sundheim, Covell & Tummino LLP

(57) ABSTRACT

An ice maker for a domestic refrigeration device with an ice-making tray having a plurality of freezing cavities, a support structure installed in the refrigeration device and rotatably supporting the ice-making tray, a rotational drive unit arranged on the support structure for driving the ice-making tray in rotation relative to the support structure, and at least one pair of electrodes arranged spaced apart from one another and having an electrical capacitance which is influenced by the contents of at least some of the freezing cavities. In addition, an electric measuring and control circuit is adapted to determine a capacitance measurement variable which is representative of the electrical capacitance of the electrode pair and to activate the rotational drive unit for rotation of the ice-making tray relative to the support structure in dependence on the fulfilment of at least one condition relating to the capacitance measurement variable.

12 Claims, 1 Drawing Sheet

ICE MAKER WITH CAPACITIVE ICE DETECTION

CROSS-REFERENCE TO RELATED APPLICATIONS

This application claims priority to German Patent Application 10 2022 110 194.0, filed on Apr. 27, 2023, the contents of which is incorporated by reference herein.

FIELD

The invention relates generally to an ice maker for a domestic refrigeration device.

BACKGROUND

Modern refrigerators or freezers are often equipped with an ice maker with which ice cubes can be produced in a quantity suitable for home use. An important criterion for the production rate of the ice maker is the freezing time, that is to say the time required for the water introduced into the freezing cavities of an ice-making tray of the ice maker to freeze completely. The faster the water freezes, the more ice cubes can be produced in a given time. For automated operation of the ice maker, in which, in an automatic operation, the finished ice cubes are ejected from the ice-making tray into a collecting container typically positioned beneath the ice-making tray, a suitable concept is required to specify the point in time at which emptying of the ice-making tray should be initiated. Purely time-based control can ensure reliable freezing of the ice cubes, provided that a sufficiently long period of time is scheduled for the freezing phase. Therefore, solutions are sought for precisely detecting by means of a suitable sensor system the point in time at which the water introduced into the ice-making tray has frozen completely. The more precisely the change of state to completely frozen is detected, the shorter the cycle time of ice-cube production can be and the sooner the ice-making tray can be filled with fresh water again. Consequently, the production rate of the ice maker can also be positively influenced by precise detection of the freezing state.

Conventional measuring methods for monitoring the process of freezing ice cubes in an ice maker of a domestic refrigeration device include infrared-based measurements, measurements by means of a temperature-dependent electrical resistor or by means of temperature-dependent semiconductor structures, and capacitive measurements. The present invention relates to the field of capacitive measurements. In the case of such capacitive measurement techniques, it is assumed that the relative dielectric permittivity of frozen water (i.e. ice) differs significantly from that of liquid water. An electrical capacitance which is measured between a pair of measuring electrodes and which is influenced by the water introduced into the freezing cavities of the ice-making tray will then show significant changes according to whether the water is still liquid or has already frozen. It is thus important that the electrodes are so positioned that the electric field generated between the electrodes when a measurement voltage is applied thereto penetrates at least some of the freezing cavities in order that the state of aggregation of the water in those freezing cavities can influence the electrical capacitance of the electrode pair. In this connection, it is known, for example, from US 2020/0064043 A1 and US 2019/0011167 A1 to provide electrodes for a capacitive measuring assembly directly on the ice-making tray.

However, ice makers as are considered in the context of the present invention have an ice-making tray that is rotatably mounted about an axis of rotation, the rotatability of which tray serves the purpose of emptying finished frozen ice cubes from the tray. If electrodes of a capacitive measuring assembly are attached to a rotatably mounted ice-making tray, electrical signal paths must be established between the ice-making tray and stationary components of the ice maker via sliding contacts or via wires, which are subject to recurrent bending each time the ice-making tray is rotated (unless techniques for wirelessly, e.g. inductively, transmitting power and data are used, which, however, will generally be uneconomical). Sliding contacts can become contaminated over time, and wires can break under frequent bending stress. It should be borne in mind here that domestic refrigerators or domestic freezers are generally intended to be used for many years, for example years or more. If ice cubes are consumed daily, this means that, over the lifetime of the refrigerator or freezer, the ice-making tray of the ice maker must be rotated into an emptying position and then rotated back into the normal position again several thousand times. When rotation of the ice-making tray is activated with such a frequency, it must be expected that the electrical signal transmission between the ice-making tray and stationary components of the ice maker will to a certain degree be susceptible to faults.

SUMMARY

An object of the invention is, therefore, to provide an ice maker which permits a lower susceptibility to faults of the electrical signal transmission from or to measuring electrodes, the electrical capacitance of which is to be measured for ice detection purposes.

In order to achieve this object, the present invention provides an ice maker for a domestic refrigeration device, comprising an ice-making tray having a plurality of freezing cavities, a support structure which is to be installed in the refrigeration device and rotatably supports the ice-making tray, a rotational drive unit, e.g. an electromotive rotational drive unit, arranged on the support structure for driving the ice-making tray in rotation relative to the support structure, at least one pair of electrodes arranged spaced apart from one another and having an electrical capacitance which is influenced by at least some of the freezing cavities, and an electric measuring and control circuit which is adapted to determine a capacitance measurement variable which is representative of the electrical capacitance of the electrode pair and to activate the rotational drive unit for rotation of the ice-making tray relative to the support structure in dependence on the fulfilment of at least one condition relating to the capacitance measurement variable. According to the invention, in such an ice maker the electrodes of the pair are arranged on the support structure.

Because the electrode pair is arranged on the support structure, no sliding contacts or wires, which would be subject to continuous bending stress, are required for electrically connecting the electrodes to the measuring and control circuit. The measuring and control circuit can likewise be arranged at least in part on the support structure; alternatively, at least parts of the measuring and control circuit can be arranged on a component of the refrigeration device that is stationary relative to the support structure, for example as part of a main controller of the refrigeration device. The inventors have recognised that, even when the electrodes are positioned on the support structure, it is possible to find a relative arrangement of the electrodes in which the electrical capacitance of the electrode pair is influenced sufficiently by the contents of at least some of the freezing cavities. Contents here means first and foremost the state of aggregation of water which has been introduced into the freezing cavities for the purpose of ice production. Accordingly, the state of aggregation of the water, that is to say liquid or frozen, must be able to be reflected in the capacitance of the electrode pair which can be detected by the measuring and control circuit. In addition, the term contents of the freezing cavities, at least in some embodiments, also means a distinguishability of air and water, that is to say whether the freezing cavities are still empty or whether they have already been filled with water. Air and liquid water are distinguished by significantly different relative dielectric permittivity, and for this reason monitoring of the capacitance of the electrode pair by measurement can also be used to ascertain whether water has already been introduced into the freezing cavities or whether they are still empty.

In some embodiments, the support structure surrounds the ice-making tray in the manner of a frame, wherein at least one of the electrodes of the pair is arranged on a frame strut of the support structure extending along a tray long side of the ice-making tray. The other electrode of the pair can be arranged on the same frame strut of the support structure, for example next to and spaced apart from the first electrode in the tray longitudinal direction or above and spaced apart from the first electrode in the direction of the tray height. Alternatively, the other electrode of the pair can be arranged on an opposite frame strut of the support structure extending along an opposite tray long side of the ice-making tray. It is also conceivable that the electrodes of the pair are arranged at right angles to one another, that is to say one of the electrodes is arranged on a frame strut of the support structure adjacent to a tray long side, while the other electrode is arranged on part of the support structure that is adjacent to a tray short side of the ice-making tray. The electrodes can be formed, for example, of a metallic film material or of sheet-metal pieces. They can be adhesively bonded to the support structure or embedded therein, for example as a result of an injection-moulding process. In principle, any material with good thermal conductivity is conceivable for the electrodes.

It has been shown that the absolute level of the capacitance measurement variable determined by the measuring and control circuit may not be meaningful or may not be sufficiently meaningful to reliably recognise therefrom when the water in the freezing cavities has frozen completely. This may, for example, be linked to the fact that the same amount of water is not always introduced into the freezing cavities in different freezing processes. Reliable indications of complete freezing of the water in the freezing cavities can, however, be obtained from the temporal profile of the capacitance measurement variable determined by the measuring and control circuit.

It has been shown that the temporal profile of the capacitance measurement variable can exhibit particular characteristics which can be observed over a large number of freezing cycles with sufficient clarity each time, even if the absolute level of the capacitance measurement variable differs from freezing cycle to freezing cycle. Thus, the first-time derivative of the capacitance measurement variable can be an important indicator on the basis of which (on its own or together with one or more further indicators) it can reliably be concluded that the water in the freezing cavities is completely frozen. Therefore, some embodiments provide that the measuring and control circuit is adapted to activate the rotational drive unit for rotation of the ice-making tray relative to the support structure in dependence on the fulfilment of a condition relating to the first-time derivative of the capacitance measurement variable.

The inventors have recognised that the gradient of the temporal profile of the capacitance measurement variable can be relatively larger during the middle part of a freezing process and can be relatively smaller at the end of the freezing process. They have, however, at the same time recognised that the gradient can likewise still be comparatively small at the beginning of the freezing process. Absolute consideration of the first-time derivative of the capacitance measurement variable alone may therefore not be sufficient to be able to reliably conclude that the water in the freezing cavities has frozen completely. Therefore, some embodiments provide that the measuring and control circuit is adapted to activate the rotational drive unit for rotation of the ice-making tray relative to the support structure further in dependence on the fulfilment of a condition relating to the second time derivative of the capacitance measurement variable. By taking the second time derivative into consideration, it can be recognised whether a particular observed value of the gradient of the capacitance measurement variable (i.e. the first time derivative) has occurred probably in an initial phase of the freezing process or probably in an end phase of the freezing process. It has been shown that the gradient typically gradually increases in the initial phase, whereas it typically gradually decreases in the end phase.

BRIEF DESCRIPTION OF THE DRAWINGS

The invention will be explained further hereinbelow with reference to the accompanying drawings, in which.

DETAILED DESCRIPTION

Figure 1:
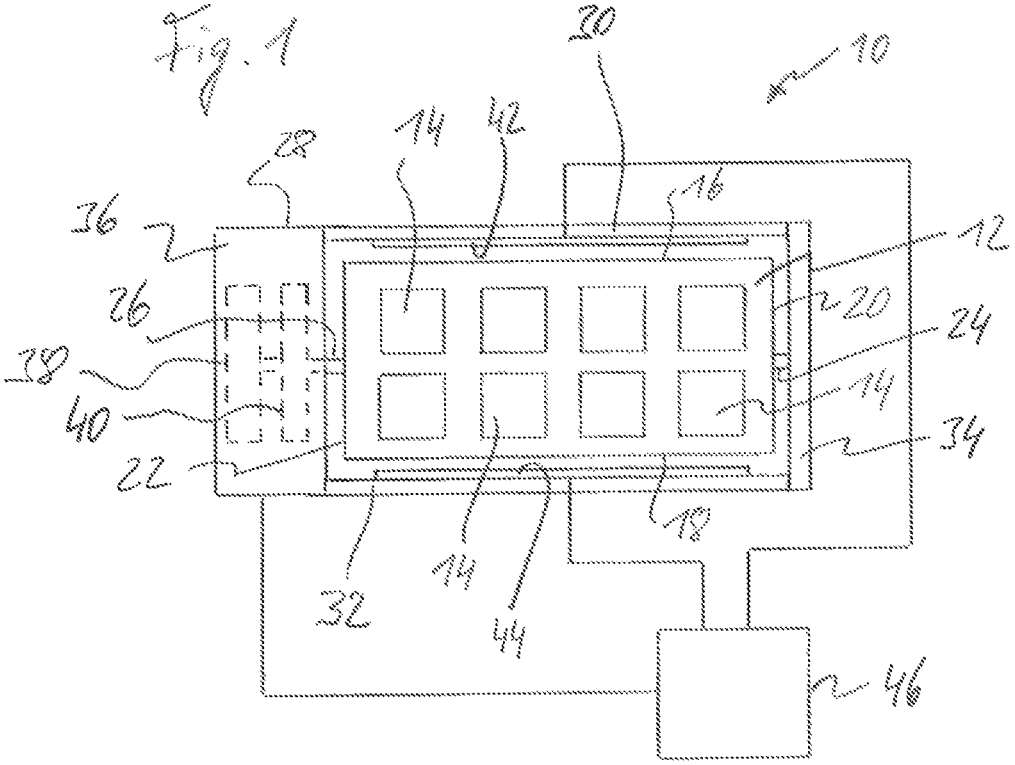
FIG. 1 shows, schematically, an ice maker according to an exemplary embodiment.

Reference will first be made to FIG. 1. The ice maker shown therein is generally designated 10. It is intended to be installed in a domestic refrigerator or a domestic freezer and serves to produce ice cubes, which are to be kept in stock in a collecting container (not shown in detail in FIG. 1) for later use by the user. The ice maker 10 comprises an ice-making tray 12 having a plurality of freezing cavities 14, which each serve to produce an ice cube and can be filled individually with fresh water from a water source (not shown in detail). The freezing cavities 14 are in the form of, for example, depressions in the ice-making tray 12, which to that end can be injection-moulded in one piece from plastics material. Where ice cubes are mentioned here, this is not necessarily to be understood in the strictly mathematical sense as meaning a cube shape. The term ice cube is used colloquially for any desired shapes of pieces of ice of a defined shape; the term ice cube is also to be understood in this colloquial meaning within the context of the present invention. Accordingly, the freezing cavities 14 do not necessarily have to correspond to the shape of a regular square prism, but can have any desired cavity cross section and can also have a variable cross-sectional size in the direction of the cavity depth. For example, the freezing cavities 14 can taper in the direction towards the base of the cavity.

In the example shown, the freezing cavities 14 are divided between two parallel rows of cavities each having four freezing cavities 14. It will be appreciated that both the number of freezing cavities 14 per row of cavities and the number of rows of cavities can be modified as desired, for example depending on the desired size of the ice cubes.

In the example shown, the ice-making tray 12 has a rectangular contour with two opposite tray long sides 16, 18 and two opposite tray short sides 20, 22. In the region of its longitudinal ends, that is to say at the tray short sides 20, 22, the ice-making tray 12 is designed with bearing structures 24, 26 by means of which the ice-making tray 12 is supported on a support structure 28 so as to be rotatable about an axis of rotation (not shown in detail in FIG. 1) running in the tray longitudinal direction. When seen from above according to FIG. 1, the support structure 28 surrounds the ice-making tray 12 in the manner of a frame, wherein it has adjacent to each of the tray long sides 16, 18 a frame strut (longitudinal strut) 30, 32 extending along the tray long side. In the example shown, the frame struts 30, 32 are spaced apart slightly from the ice-making tray 12 and extend over the entire length of the tray. The support structure 28 additionally comprises on the far side of each of the longitudinal ends of the ice-making tray 12 a structure part 34, 36 serving as a cross-bridge, each of which is connected to the two frame struts 30, 32 and thereby closes the frame struts 30, 32 to form a frame encircling the ice-making tray 12.

In the example shown there are accommodated in the structure part 36 an electric motor 38, which serves as a rotational drive unit for driving the ice-making tray 12 in rotation, and a reducing gear 40 arranged downstream of the electric motor 38 (both indicated by broken lines). The reducing gear 40 can be omitted in some embodiments, for example if the electric motor 38 is formed by a step motor. By actuation of the electric motor 38, the ice-making tray 12 can be rotated from a freezing operating position, in which it is oriented with its tray plane substantially horizontal, into an emptying position, in which finished ice cubes are able to fall out of the ice-making tray 12. Because the ice cubes can freeze to the ice-making tray 12 during the freezing process, a stop formation (not shown in detail) can be provided on the support structure 28 and limits the rotation angle of the ice-making tray 12 in the region of its non-driven longitudinal end. By continued rotation of the driven longitudinal end (i.e. the longitudinal end of the ice-making tray 12 adjacent to the structure part 36), twisting of the ice-making tray 12 about its tray longitudinal axis can thus be achieved, which results in the ice cubes breaking away from the surface of the ice-making tray 12. This working principle of the ice maker 10 is generally known among experts by the expression "twisted tray" and does not require further explanation at this point.

After fresh water has been introduced into the freezing cavities 14, it is desirable to detect as precisely as possible the point in time at which the water in the freezing cavities 14 has frozen completely. The longer the finished ice cubes remain in the freezing cavities 14 before they are ejected from the ice-making tray 12, the lower the ice production rate of the ice maker 10. For monitoring the freezing process by means of a sensor system, the ice maker 10 is designed with a capacitive sensor assembly, which in the example shown comprises two sensor electrodes (measuring electrodes) 42, 44 which are each arranged on one of the frame struts 30, 32 of the support structure 28. It will be seen that the sensor electrodes 42, 44 in the example shown are arranged on the inner sides of the frame struts 30, 32 facing the ice-making tray 12, wherein they can be adhesively bonded, for example, to the surface of the frame struts 30, 32. The sensor electrodes 42, 44 can be formed, for example, of metallic film material or of sheet-metal strips. It is of course possible within the context of the invention to arrange the sensor electrodes 42, 44 on the outer sides of the frame struts 30, 32 remote from the ice-making tray 12 or to embed them into the material of the frame struts 30, 32, for example if the frame struts 30, 32 are produced by injection moulding.

It will be seen that, in the example shown, the sensor electrodes 42, 44 extend along the longitudinal direction of the ice-making tray 12 over such a distance that all the freezing cavities 14 of the ice-making tray 12 are covered by the electric field which forms between the sensor electrodes 42, 44 when a measurement voltage is applied thereto. It should, however, be noted that it is not necessary that the length of the sensor electrodes 42, 44 corresponds at least to the length of the rows of cavities. Thus, it is conceivable, for example, that the freezing process takes longer in some freezing cavities 14 than in other freezing cavities 14. For example, it could be that—looking in the direction of a row of cavities—the freezing process takes longer in a middle region of the row of cavities than in the end regions of the row of cavities. It could then be sufficient to configure the sensor electrodes 42, 44 with a length such that they cover substantially only the middle portion of a row of cavities but not the freezing cavities 14 at the ends of the row of cavities in question. Numerous modifications are conceivable in this respect with regard to the length of the sensor electrodes 42, 44.

It is moreover also conceivable to provide on the support structure 28 a plurality of pairs of sensor electrodes 42, 44, the electric fields of which each cover a different group of freezing cavities 14.

Alternatively to the position of the sensor electrodes 42, 44 opposite one another (i.e. on the two opposing frame struts 30, 32) shown in FIG. 1, it is conceivable to provide the two sensor electrodes 42, 44 on the same frame strut 30 or 32, for example next to one another in the tray longitudinal direction or one above the other in the direction of the height of the ice-making tray 12. In such a case, the electric field between the sensor electrodes 42, 44 will primarily cover only the freezing cavities 14 of one row of cavities. The freezing cavities 14 of the other row of cavities in this case remain largely unaffected by the electric field of the sensor electrodes 42, 44. Should it be desired separately to capacitively monitor also the freezing cavities 14 of the other row of cavities, the other frame strut could also be equipped with a pair of further sensor electrodes.

The sensor electrodes 42, 44 are connected to an electric measuring and control circuit 46, which is adapted to apply an electric measurement voltage (e.g. a pulsed square-wave voltage) to the sensor electrodes 42, 44 and to determine a capacitance measurement variable that is representative of the electrical capacitance between the sensor electrodes 42, 44. For example, the measuring and control circuit 46 can comprise for this purpose a Wheatstone bridge circuit. Such bridge circuits are generally common for the purposes of capacitance measurement, and for this reason a more detailed explanation is not necessary at this point. As soon as the measuring and control circuit 46 ascertains, on the basis of the determined capacitance measurement variable, that the water in the freezing cavities 14 is sufficiently frozen, it sends a control signal to the electric motor 38 in order to initiate a process of emptying the ice-making tray 12.

Figure 2:
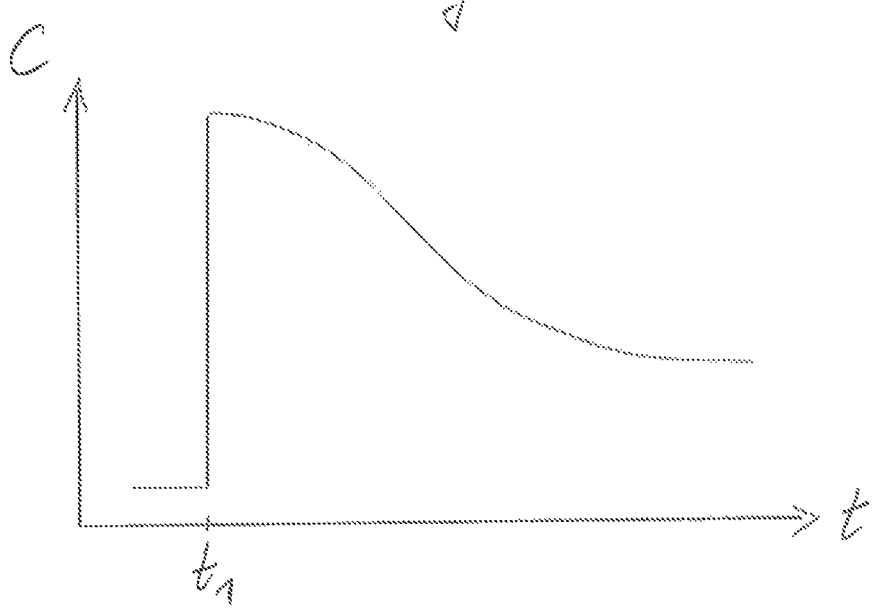
FIG. 2 shows, schematically, a representative time diagram for the electrical capacitance measured between two measuring electrodes of the ice maker of FIG. 1.

FIG. 2 shows, schematically, a representative qualitative time profile of the capacitance measurement variable, denoted C, determined by the measuring and control circuit 46 during a freezing process. At a time ti, water is introduced into the previously empty freezing cavities 14. Liquid water has a considerably higher relative dielectric permittivity than air, and for this reason the value of the capacitance measurement variable C immediately increases significantly in response to the introduction of water into the freezing cavities 14.

In the subsequent freezing phase, a gradual fall in the value of the capacitance measurement variable C can be observed, wherein the magnitude of the gradient of the curve C(t) is initially small, then becomes greater, and towards the end of the freezing phase becomes smaller again, before the value of C reaches a comparatively stable end value, which no longer changes substantially even when the freezing process is continued, because the water in the freezing cavities 14 is already completely frozen. In this respect, complete freezing of the water in the freezing cavities 14 can be ascertained by considering the gradient of the curve C(t), wherein the reaching of a specific, comparatively small absolute value of the gradient, after passing through a phase of comparatively large absolute values of the gradient, can be used as an indicator that the water in the freezing cavities 14 is frozen. To that end, the first and second time derivatives of the curve C(t) can be evaluated. If both the first time derivative and the second time derivative fulfil specific criteria, this can be used as an indication that the water in the freezing cavities 14 is now sufficiently frozen. The absolute value of the capacitance measurement variable C can also be used as an additional criterion if required. The inventors have, however, recognised that consideration of the absolute value of the capacitance measurement variable C alone often does not give a sufficiently reliable indication of the actual freezing state of the water in the freezing cavities 14.

The invention claimed is:

1. An ice maker for a domestic refrigeration device, comprising:

an ice-making tray having a plurality of freezing cavities;

a support structure configured for installation in the refrigeration device and adapted to rotatably support the ice-making tray, wherein the support structure surrounds the ice-making tray in the manner of a frame having a frame strut extending along a tray long side of the ice-making tray;

a rotational drive unit, arranged on the support structure for driving the ice-making tray in rotation relative to the support structure;

at least one pair of electrodes arranged spaced apart from one another and having an electrical capacitance which is influenced by the contents of at least some of the freezing cavities; and an electric measuring and control circuit configured to determine a capacitance measurement variable which is representative of the electrical capacitance of the electrode pair and to activate the rotational drive unit for rotation of the ice-making tray relative to the support structure in dependence on the fulfilment of at least one condition relating to the capacitance measurement variable, wherein the electrodes of the pair are arranged on the support structure with at least one of the electrodes of the pair being arranged on the frame strut.

2. The ice maker according to claim 1, wherein the rotational drive unit is an electromotive rotational drive unit.

3. The ice maker according to claim 1, wherein the measuring and control circuit is configured to activate the rotational drive unit for rotation of the ice-making tray relative to the support structure in dependence on the fulfilment of a condition relating to the first-time derivative of the capacitance measurement variable.

4. The ice maker according to claim 3, wherein the measuring and control circuit is adapted to activate the rotational drive unit for rotation of the ice-making tray relative to the support structure further in dependence on the fulfilment of a condition relating to the second time derivative of the capacitance measurement variable.

5. The ice maker according to claim 1, wherein the measuring and control circuit is configured to activate the rotational drive unit for rotation of the ice-making tray relative to the support structure in dependence on the fulfilment of a condition relating to a first-time derivative of the capacitance measurement variable.

6. The ice maker according to claim 5, wherein the measuring and control circuit is adapted to activate the rotational drive unit for rotation of the ice-making tray relative to the support structure further in dependence on the fulfilment of a condition relating to a second time derivative of the capacitance measurement variable.

7. The ice maker according to claim 1, wherein the other electrode of the pair is arranged on the same frame strut of the support structure or on an opposite frame strut of the support structure extending along an opposite tray long side of the ice-making tray.

8. The ice maker according to claim 7, wherein the measuring and control circuit is configured to activate the rotational drive unit for rotation of the ice-making tray relative to the support structure in dependence on the fulfilment of a condition relating to the first-time derivative of the capacitance measurement variable.

9. The ice maker according to claim 8, wherein the measuring and control circuit is adapted to activate the rotational drive unit for rotation of the ice-making tray relative to the support structure further in dependence on the fulfilment of a condition relating to the second time derivative of the capacitance measurement variable.

10. The ice maker according to claim 1, wherein the electrodes of the pair are each arranged on an inner side of the support structure facing the ice-making tray.

11. The ice maker according to claim 1, wherein the electrodes of the pair are each arranged on an outer side of the support structure remote from the ice-making tray.

12. The ice maker according to claim 1, wherein the electrodes of the pair are each embedded within the support structure.

* * * * *